US007640617B2

(12) United States Patent
Kennedy et al.

(10) Patent No.: US 7,640,617 B2
(45) Date of Patent: Jan. 5, 2010

(54) CLEANING DEVICE INCLUDING A PIVOT JOINT

(75) Inventors: Brook Kennedy, Jackson Heights, NY (US); Richard Whitehall, New York, NY (US); Davin Stowell, New York, NY (US); Boris Kontorvich, Brooklyn, NY (US)

(73) Assignee: Helen of Troy Limited, St. Michael (BB)

( * ) Notice: Subject to any disclaimer, the term of this patent is extended or adjusted under 35 U.S.C. 154(b) by 117 days.

(21) Appl. No.: 11/716,098

(22) Filed: Mar. 9, 2007

(65) Prior Publication Data

US 2008/0216262 A1 Sep. 11, 2008

(51) Int. Cl.
*B25G 3/38* (2006.01)
*B25G 1/06* (2006.01)

(52) U.S. Cl. ..... 15/144.1; 15/144.2; 403/76; 403/90; 403/122

(58) Field of Classification Search ..... 15/144.1, 15/144.2; 16/422, 429; 403/76, 90, 122
See application file for complete search history.

(56) References Cited

U.S. PATENT DOCUMENTS

| | | | | |
|---|---|---|---|---|
| 57,656 | A | 9/1866 | Alden | |
| 347,123 | A * | 8/1886 | Nunn | 403/100 |
| 486,726 | A | 11/1892 | Mendelson | |
| 1,795,651 | A | 3/1931 | Hunter | |
| 1,982,910 | A | 12/1934 | Forbes | |
| 2,191,348 | A | 2/1940 | Lauterbach | |
| 2,425,852 | A | 8/1947 | Young | |
| 2,555,226 | A | 5/1951 | Draughn | |
| 2,649,104 | A | 8/1953 | Militano | |
| 2,775,779 | A | 1/1957 | Nelson | |
| 2,818,291 | A * | 12/1957 | Corns | 403/102 |
| 2,895,757 | A * | 7/1959 | Kaspar | 403/100 |
| 2,993,222 | A | 7/1961 | Laymon | |
| 3,187,373 | A | 6/1965 | Fisher | |
| 3,380,767 | A | 4/1968 | Barth | |
| 3,773,375 | A | 11/1973 | Nehis | |
| 4,473,918 | A | 10/1984 | Moss et al. | |
| 4,654,922 | A * | 4/1987 | Chen | 15/172 |
| 4,796,325 | A * | 1/1989 | Bortman | 15/167.2 |
| 5,144,713 | A | 9/1992 | Unger | |
| 5,370,396 | A | 12/1994 | Bloom | |
| 5,996,162 | A | 12/1999 | Hsu | |
| 6,709,529 | B1 | 3/2004 | Mekwinski | |
| 7,003,849 | B2 | 2/2006 | Cohen et al. | |
| 2004/0250367 | A1 | 12/2004 | Fraser | |
| 2005/0251940 | A1 | 11/2005 | Black | |
| 2006/0200924 | A1 | 9/2006 | Hampton | |

* cited by examiner

*Primary Examiner*—Mark Spisich
(74) *Attorney, Agent, or Firm*—Seyfarth Shaw LLP

(57) ABSTRACT

A cleaning device including a cleaning member and a handle connected to the cleaning member. The handle includes a first member and a second member. The first member includes a ball member and the second member includes a socket. The ball member being disposed in the socket to couple the first member and the second member and enable the second member to pivot with respect to the first member.

19 Claims, 6 Drawing Sheets

CLEANING DEVICE INCLUDING A PIVOT JOINT

BACKGROUND

There are many different types of cleaning devices and tools which are used to clean counters, walls, floors and other surfaces. Some cleaning devices are handheld devices, such as scrub brushes and the like which are held in a user's hand and moved across a surface to remove and clean the surface. Other cleaning devices include handles which enable the user to extend the cleaning device to places spaced from the user. Such handles also enable a user to be able to stand while cleaning, such as the handles on most brooms, dust sweepers and mops.

In particular, brooms, dust sweepers and mops have elongated handles. These handles are typically made out of wood, steel or some other durable material which enables the user to hold the cleaning device and maneuver it along the floor, wall or other similar surface to clean those surfaces. Such handles, however, make cleaning under items such as couches and coffee tables, difficult, because the user has to bend down or significantly lower the handle of the cleaning device to be able to extend the cleaning end of the device under the item. This makes cleaning floors and other surfaces that underlie these items difficult. Additionally, a user typically has to bend his or her body, crouch down closer to the floor, or both, to be able to maneuver the end of the cleaning device under such items. This adds stress to the user's body as well as making such work burdensome, difficult and tiring.

It is known to provide handles with sections which can pivot relative to each other, but typically such handles can pivot about one axis or use as a pivot joint, a coil spring which lacks rigidity and impairs control.

Accordingly, there is a need for an improved handle for a cleaning device that overcomes the above problems.

SUMMARY

One embodiment provides a cleaning device including a cleaning member and a handle connected to the cleaning member. The handle includes a first member and a second member. The first member includes a ball member and the second member includes a socket. The ball member is disposed in the socket to couple the first member and the second member and enable the second member to pivot with respect to the first member.

In an embodiment, the socket includes a plurality of fingers.

In an embodiment, the fingers are made of at least one of: a flexible material and a rigid material.

In an embodiment, the socket includes a slot having a ball-shaped upper portion and a elongated lower portion.

In an embodiment, the cleaning device includes a first connector including the socket and a second connector including the ball member. The first connector is removably connected to the first member and the second connector is removably connected to the second member.

In an embodiment, at least one of the first and second members includes a cavity, where at least one of the first connector and the second connector includes ridges which frictionally engage an inside surface of the cavity.

In an embodiment, the first member includes a grip.

In an embodiment, the cleaning member is at least one of: a brush, a dust mop and a mop.

Another embodiment provides a cleaning device including a cleaning member and a handle connected to the cleaning member. The handle includes a first member and a second member. The first member includes a ball member and the second member includes a socket. The ball member is disposed in the socket to couple the first member and the second member and enable the second member to pivot with respect to the first member. The cleaning device also includes a sleeve slidably connected to the handle and movable between a first position, which allows the second member to pivot, and a second position, which does not allow the second member to pivot.

In an embodiment, the second member includes a prong-shaped collar and the sleeve defines a prong-shaped end, where the prong-shaped end of the sleeve engages the prong-shaped collar when the sleeve is in the second position.

In an embodiment, the sleeve includes an actuator, which when activated, releases the sleeve from one of the first and second positions.

In an embodiment, the cleaning device includes a first connector that includes the socket and a second connector that includes the ball member. The first connector is removably connected to the first member and the second connector is removably connected to the second member.

In an embodiment, at least one of the first and second members includes a cavity, where at least one of the first connector and the second connector includes ridges which frictionally engage an inside surface of the cavity.

In an embodiment, the cleaning member is at least one of: a brush, a dust mop and a mop.

A further embodiment provides a cleaning device including a cleaning member and a handle connected to the cleaning member. The handle includes a first member and a second member. The first member defines a socket and the second member defines an opening. The cleaning device also includes a pivot member including a first end having a ball member and an opposing second end. The second end is disposed in the opening and secured to the second member. The ball member is disposed in the socket to couple the first member and the second member and enable the second member to pivot with respect to the first member.

In an embodiment, the cleaning device includes a sleeve that is slidably connected to the handle and movable between a first position, which allows the second member to pivot, and a second position which at least partially covers the pivot assembly and which does not allow the second member to pivot.

In an embodiment, the second member includes a prong-shaped collar and the sleeve defines a prong-shaped end, where the prong-shaped end of the sleeve engages the prong-shaped collar when the sleeve is in the second position.

In an embodiment, the sleeve includes an actuator, which when activated, releases the sleeve from one of the first and second positions.

In an embodiment, the cleaning device includes a first connector including the socket and a second connector connected to the pivot member, where the first connector is removably connected to the first member and the second connector is removably connected to the second member.

In an embodiment, at least one of the first and second members includes a cavity, where at least one of the first connector and the second connector includes ridges which frictionally engage an inside surface of the cavity.

In an embodiment, the cleaning member is at least one of: a brush, a dust mop and a mop.

It is therefore an advantage of the present invention to provide a cleaning device which enables a user to easily clean hard to reach places.

Another advantage of the present invention is to provide a cleaning device including a handle having a pivot joint which enables a user to easily clean floors and other surfaces.

A further advantage of the present invention is to provide a cleaning device including a handle having a pivot joint which minimizes the stress on a user's body during cleaning.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION

Figure 1:
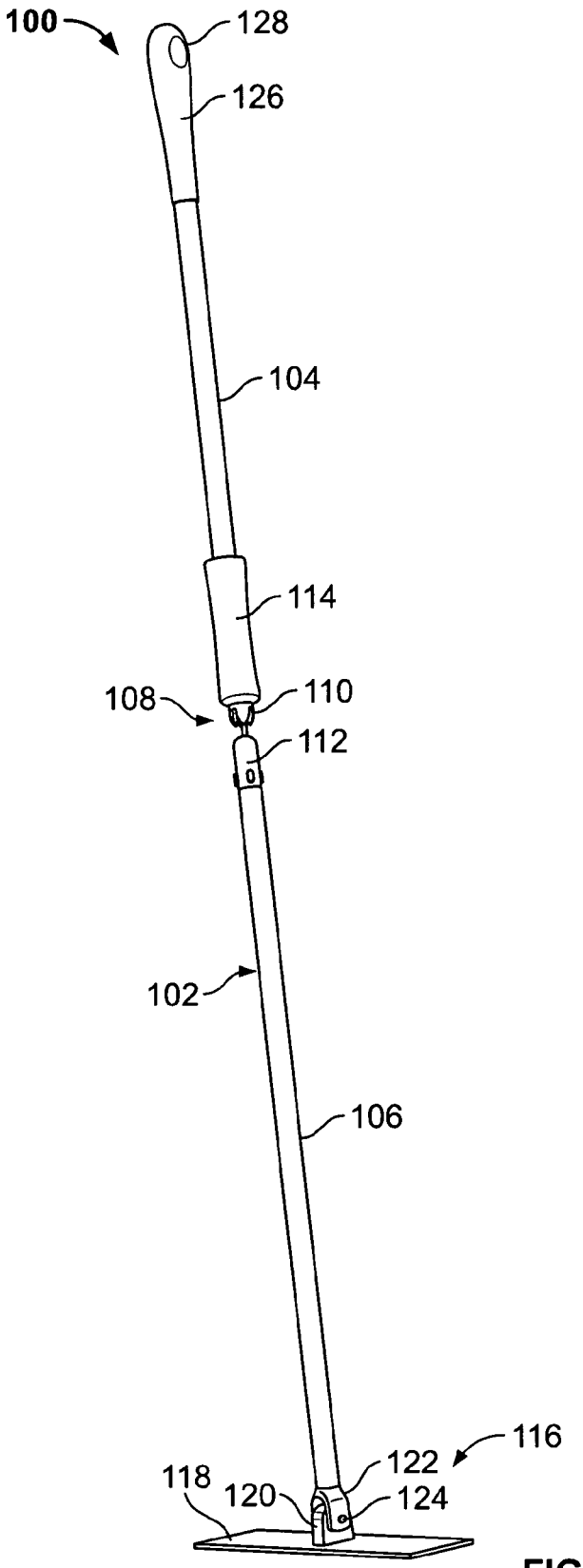
FIG. 1 is a perspective view of a cleaning device of the present invention where the cleaning device includes a handle with a pivot joint.

The present invention is directed to a cleaner, such as floor cleaner, for a home, office, or other area. Referring to FIG. 1, the cleaning device or cleaner 100 includes an elongated handle 102 and a cleaning member 116 connected to the handle. A user grasps the handle 102 and moves the cleaning member across a surface such as a floor to clean that surface. The handle 102 may be any suitable size or length. Additionally, the cleaning member 116 can be any suitable cleaning member such as a broom or brush, sweeper, dust mop, mop and the like. In an embodiment, the cleaning member 116 is removably connected to the handle 102 so that the cleaning member can be replaced as needed or interchangeable with other cleaning members, such as those described above.

Figure 3:
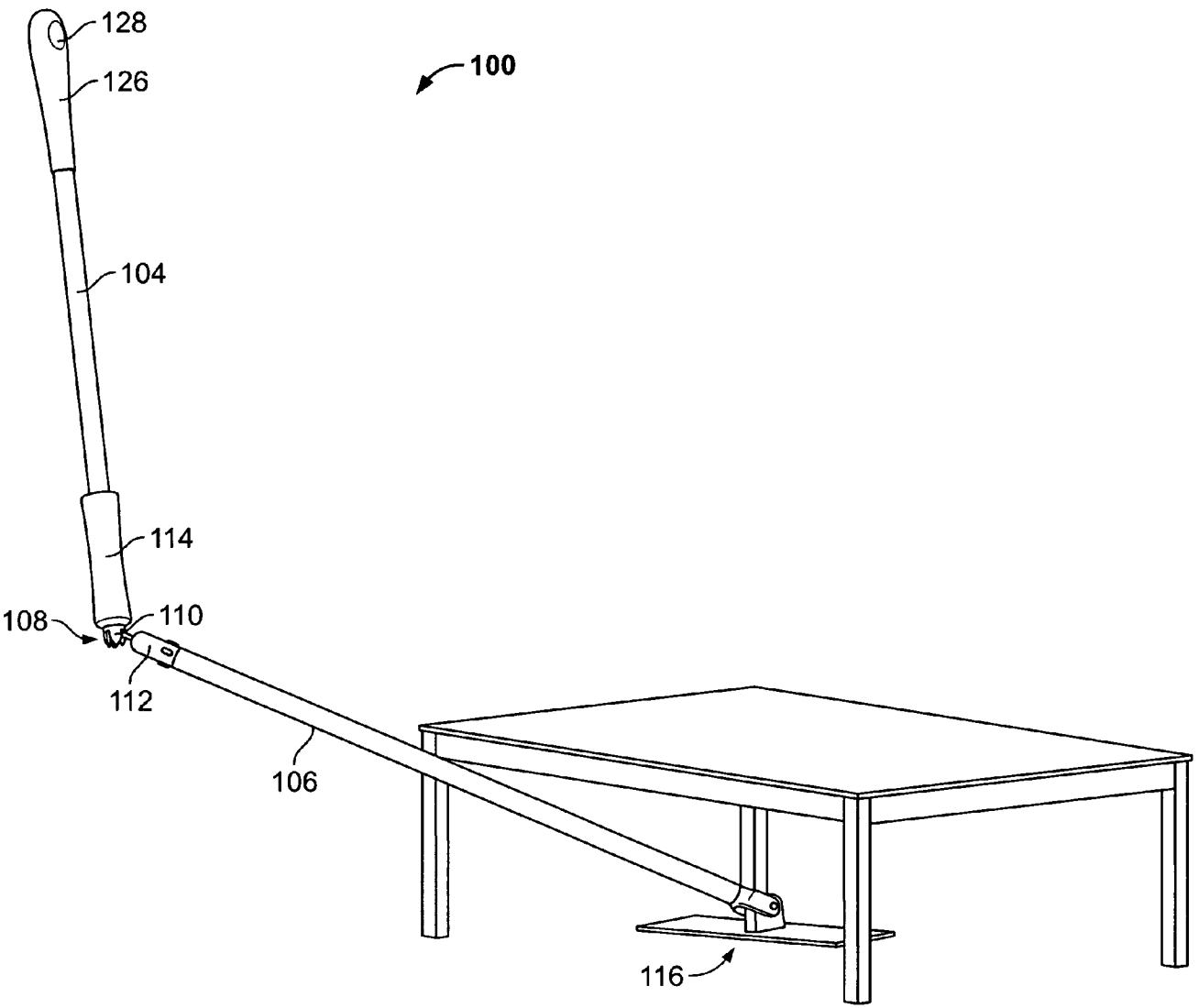
FIG. 3 is a perspective view of the cleaning device of FIG. 1 wherein the handle of the cleaning device is pivoted about the pivot joint to clean under a table.

The handle 102 includes first and second members 104 and 106 joined by a pivot joint or pivot assembly 108. The pivot assembly 108 enables the first and second members 104 and 106 to pivot relative to each other about a point intermediate the ends of the handle so that the cleaner 100 can be maneuvered to clean under items such as couches and tables as shown in FIG. 3. The pivot assembly 108 of the handle 102 allows the handle to be bent, angled or pivoted to clean in hard to reach places of a floor or other surface without causing the user to have to bend down, squat down, or perform some other function which stresses their body.

Figure 2:
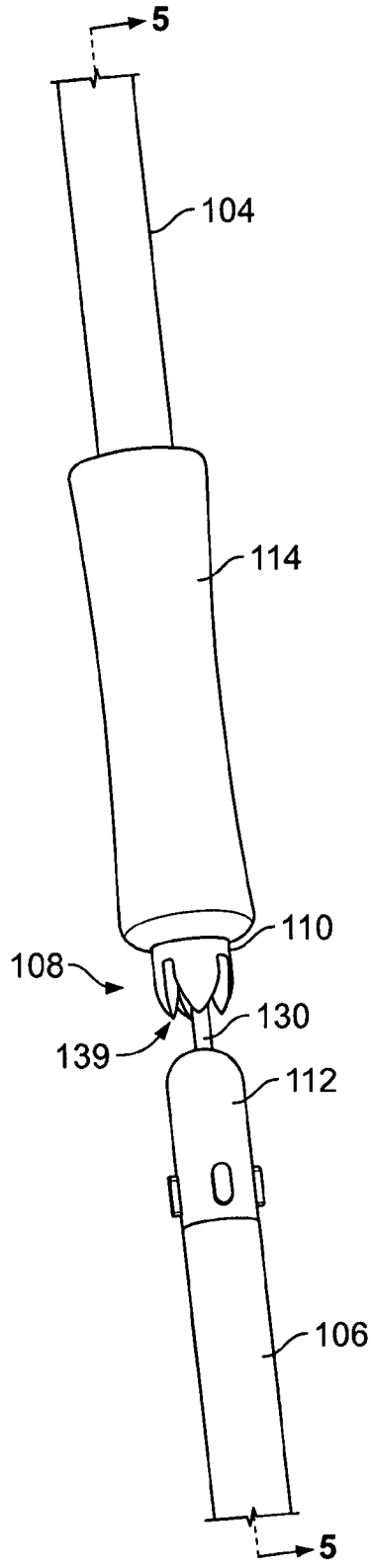
FIG. 2 is an enlarged, fragmentary, perspective view of a portion of FIG. 1 illustrating the pivot joint.
Figure 4:
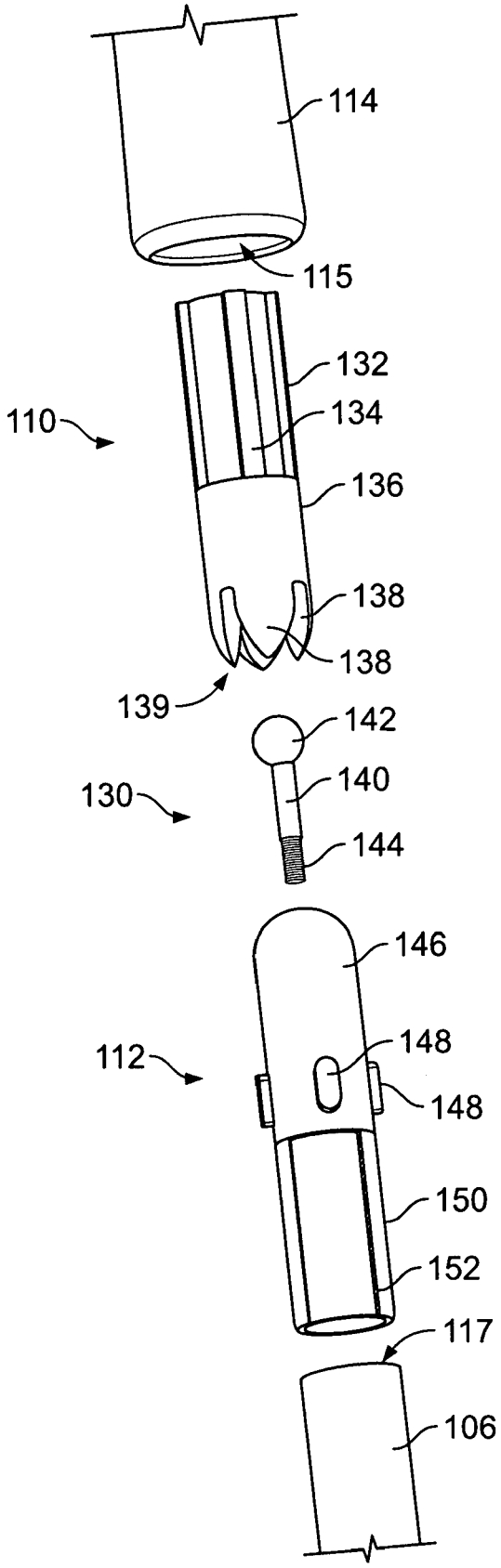
FIG. 4 is a fragmentary, exploded, perspective view of an embodiment of the pivot joint of FIG. 2.
Figure 5:
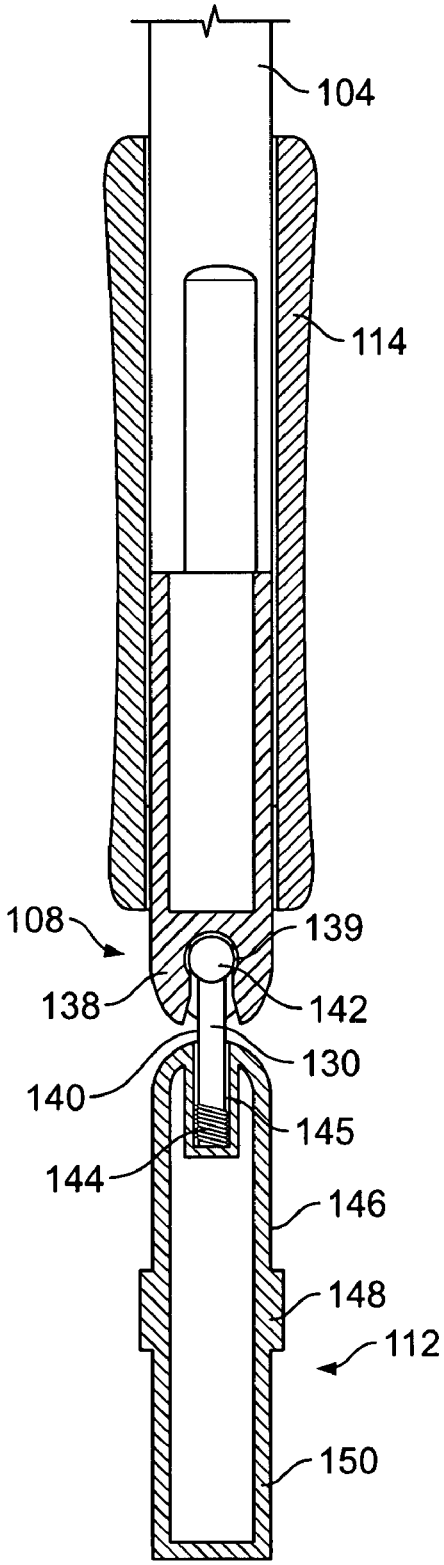
FIG. 5 is a fragmentary cross-section view of the pivot joint taken substantially along the line 5-5 of FIG. 2, wherein the sleeve of the pivot joint is shown in the open position.

Referring to FIGS. 2 and 4, the pivot assembly 108 includes a first connector 110 and a second connector 112, which are coupled together by a pivot member or pivot post 130. The first connector 110 includes a connecting portion 132 and a pivot portion 136. The connecting portion 132 includes friction ridges 134 which are elongated, protruding portions of the connecting portion 132 that frictionally engage an inside surface or inside wall of a cavity or opening 115 in the first member 104 as the connecting portion 132 of the first connector 110 is inserted into the opening 115 defined by the first member 104. The friction fit between the connecting portion 132 of first connector 110 and the inside surface of the first member 104 securely holds the first connector 110 and the first member 104 together. The pivot portion 136 of the first connector includes a plurality of fingers 138. The fingers 138 are generally triangularly shaped as shown in FIG. 4. It should be appreciated that the fingers 138 may be any suitable size or shape. The fingers may be made of a durable, flexible material. In another embodiment, the fingers may be made of a rigid material. It should be appreciated that the fingers may be made of any suitable material or combination of materials. In the illustrated embodiment, the pivot portion 136, and more specifically, the fingers 138 define a receptacle or socket 139 for receiving pivot post 130 as described below.

second connector 112 has a rounded portion 146 and a connecting portion 150 which are integrally formed. It should be appreciated that the rounded portion 146 and the connecting portion 150 may be separate components that are connected together. The connecting portion 150 includes a plurality of friction ridges 152 similar to the ridges of the first connector 110. The friction ridges 152 engage an inside surface of an opening or cavity 117 in the second member 106 to frictionally secure the second connector 112 to the second member 106. The rounded portion 146 includes a plurality of protruding guides 148 which are generally oval-shaped. It should be appreciated that the guides 148 may be any suitable size or shape. Specifically, the guides 148 are designed to fit in between the fingers 138 of the first connector.

The first member 104 and the second member 106 are coupled together by the pivot assembly 108. The pivot post 130 includes a shaft 140, a ball-shaped head or ball 142 and a threaded end 144. The threaded end 144 is disposed in or inserted in an opening 145 defined by the rounded portion 146 and is threadingly engaged in that opening to securely hold the pivot post in engagement with the second connector 112.

To connect the pivot post to the first member, the ball 142 is pushed against the ends of the fingers 138 until the fingers flex outwardly to allow the ball 142 to move into the receptacle or socket 139 defined by the fingers 138. The receptacle or socket 139 is formed in such a way that the ball 142 and, more specifically, the second member 106 of the handle 102 can pivot in many different directions. Alternatively, it should be appreciated that the second member can have the fingers 138 forming socket 139 and the pivot member or pivot post 130 can be integrally formed with or secured to the first member.

Figure 9:
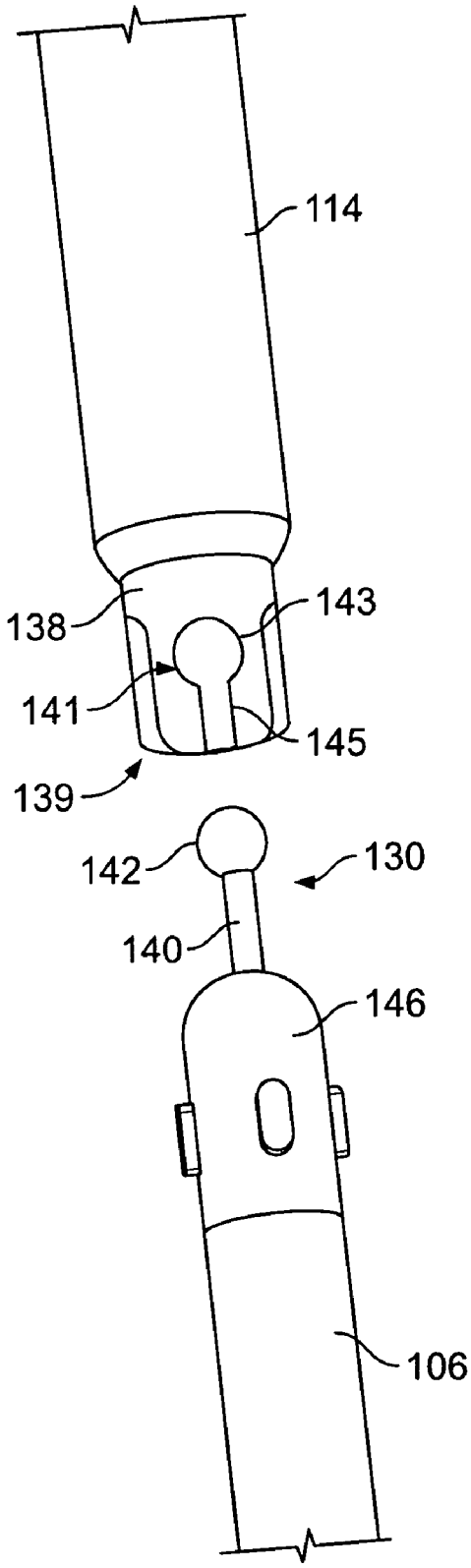
FIG. 9 is an enlarged, fragmentary, perspective view of an alternative embodiment of the pivot joint.

Referring to FIG. 9, in an alternative embodiment, the first member 104 includes a "keyhole" like opening 141 instead of the fingers 138. The opening 141 includes a generally circular top opening 143 and an elongated slot opening 145 that extends from the top opening 143. The rounded top opening 143 has a size and shape that corresponds to the size and shape of the ball member 142. The width of slot opening 145 corresponds to the size or width of shaft 140. To couple the top and bottom members together, the ball member 142 is disposed in the rounded top opening 143. The second member 106 is moved downwardly so that the shaft 140 moves downward through the slot opening 145 until the ball member 143 is in socket 139.

In another alternative embodiment, the pivot member or pivot post 130 is moved downwardly through an opening extending the length of the first member until the ball member 142 is in the socket 139 and the shaft 140 extends from the socket. The threaded end of the pivot post 130 is then secured in an opening 145 defined by the top of second member as described above.

A sleeve 114 is slidably connected to at least one of the first and second members of 104 and 106. Referring to FIGS. 1, 3, 5, and 6, the sleeve 114 is slidably connected to the first member and slides or moves between a first, open or pivoting position, and a second, closed or non-pivoting position. In the first or open position, shown in FIGS. 1 and 5, sleeve 114 is moved along the first member 104 and away from the pivot joint or pivot assembly 108, so that the first connector can pivot with respect to the second connector. In the first or open position, the first and second members 104 and 106 are able to pivot with respect to each other and enable the user to clean hard to reach places on a floor and other surfaces. During pivoting the post 140 moves into a slot between adjacent fingers 138. There are plural slots providing plural pivot axes, the number of which is determined by the number of fingers.

Figure 6:
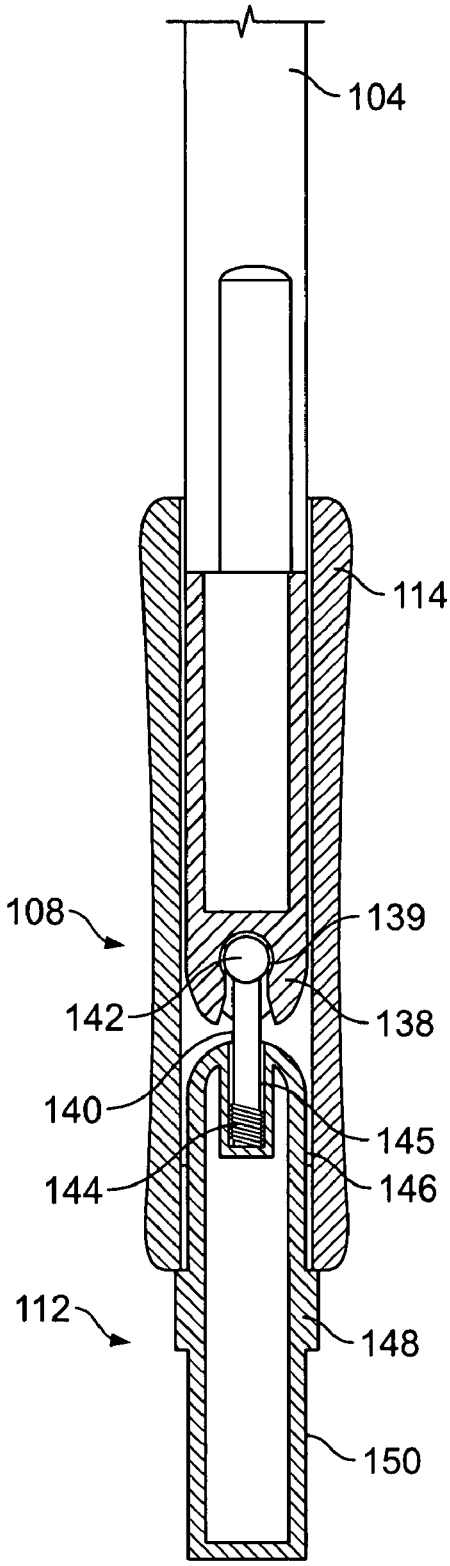
FIG. 6 is a view similar to FIG. 5, wherein the sleeve is shown in the closed position.

Alternatively, if a user wants the handle 102 to be straight and non-pivoting, the user grasps the sleeve 114 and slides it toward the cleaning member 116 until the sleeve 114 at least partially covers the first and second connectors 110 and 112. As shown in FIG. 6, in an embodiment, the sleeve 114 completely surrounds or covers the pivot assembly 108 and prevents the first and second members 104 and 106 from pivoting with respect to each other. The sleeve 114, therefore, is moved between the first or open position where the first and second members 104 and 106 can pivot with respect to each other and the closed or non-pivoting position which prevents the handle 102 from pivoting at the pivot joint or pivot assembly.

The cleaner 100, and more specifically, the handle 102, also includes a grip 126, made of an elastomeric material or other suitable material, that defines an opening 128. The opening enables a user to be able to insert a hook or other device though the opening to hang the cleaner for storage. It should be appreciated that the grip 126 may include one or more openings.

Figure 7:
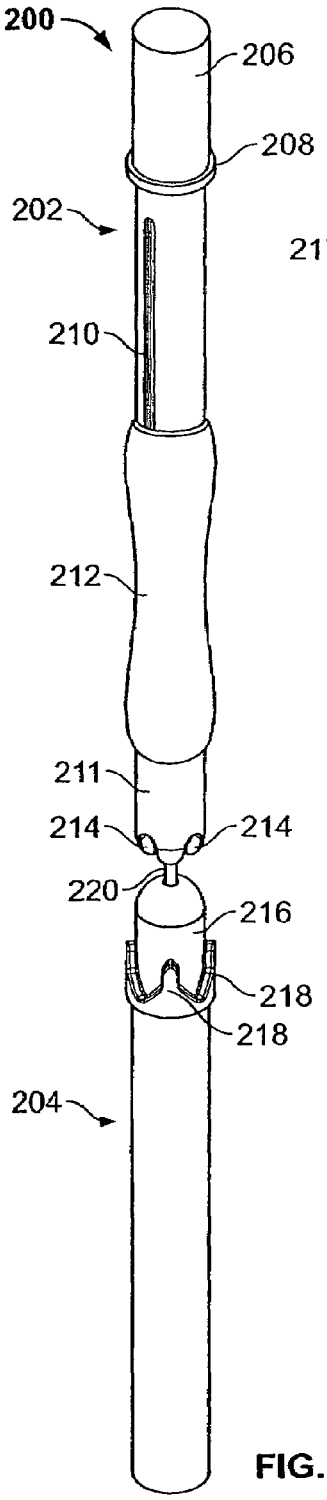
FIG. 7 is a perspective view of an alternative embodiment of the pivot joint.
Figure 8:
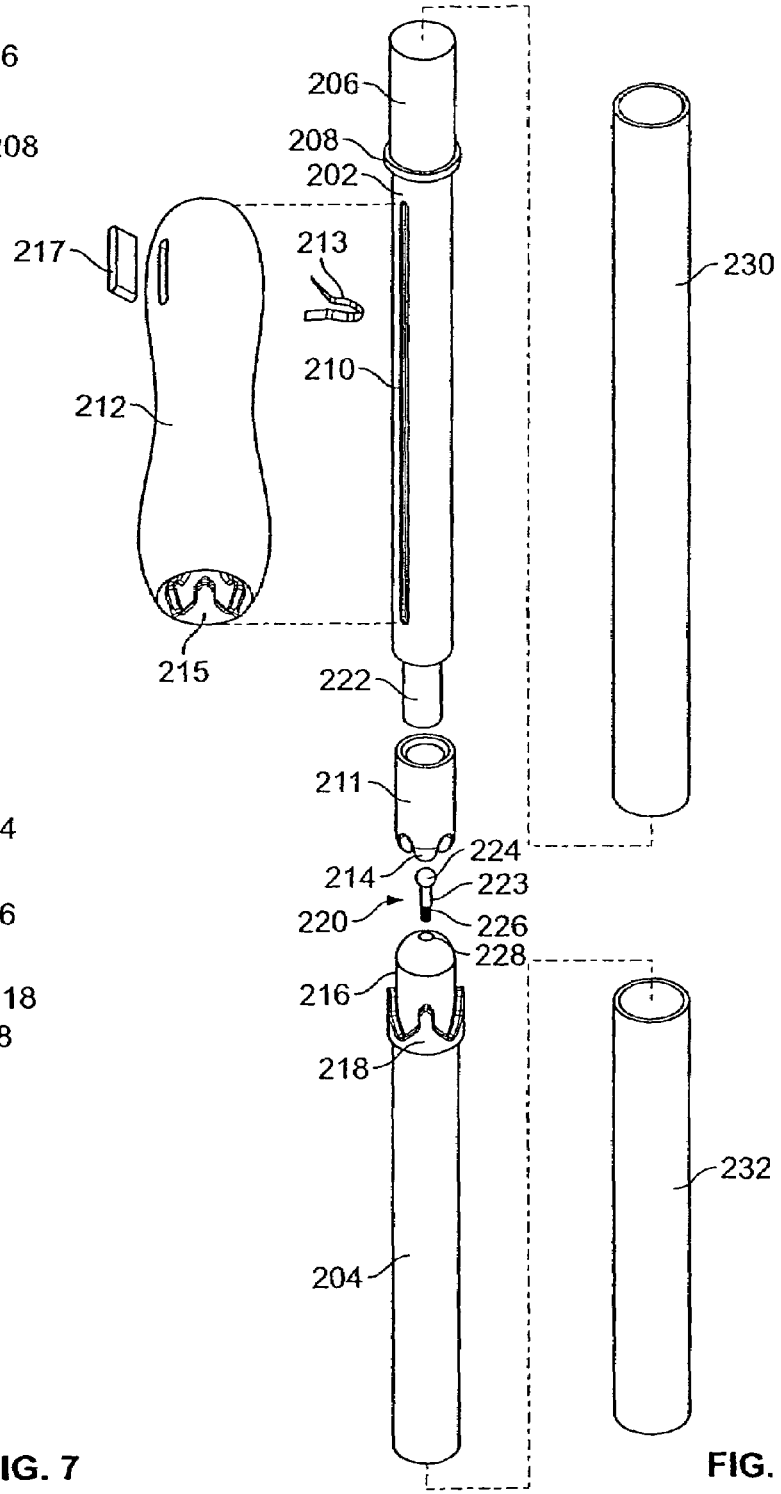
FIG. 8 is an exploded perspective view of the pivot joint of FIG. 7.

Referring now to FIGS. 7 and 8, and alternative embodiment of the pivot assembly is shown wherein a handle 200 includes a first member 202 and a second member 204 which are coupled together to pivot with respect to each other. The first member 202 includes a friction post 206 and has an annular flange 208. The friction post 206 is insertable into an end of a hollow first handle 230. The first member 202 defines an elongated slot 210, and a movable sleeve 212 that includes a clip 213 which engages the slot and is secured to the sleeve to hold the sleeve in place and guide the sleeve along the slot 210 to prevent relative rotational movement. The first member 202 includes a first connector 211 which includes fingers 214 and defines a receptacle as described above. The connector 211 may be generally tubular and frictionally fit over a reduced-diameter portion 222 of the first member 202.

The second member 204 includes a round dome-shaped portion 216 and raised ridges 218. The ridges 218 may be any suitable size and shape and engage the corresponding shapes of the internal pattern 215, as shown in FIG. 7. In an embodiment, the sleeve 212 may include an actuator or button 217 which engages or releases the clip 213 with the slot 210 so that the sleeve 212 may be moved or stopped with respect to the first connector 202. In another embodiment, the sleeve 212 does not include actuator 217. In this embodiment, the sleeve 212 is slidably connected to at least one of the first and second members as described above.

A pivot post 220 couples the first member 202 to the second member 204. The pivot post 220 includes a ball shaped end or ball 224 and a threaded end 226. The threaded end 226 is inserted into an opening 228 defined by the dome-shaped portion of the second member 202 that is threadingly engaged inside the opening to hold it securely to the second member. The pivot post 220 enables the first and second members 202 and 204 to pivot with respect to each other to allow a user to pivot or bend the handle about the pivot point to be able to easily reach difficult-to-clean areas under a countertop, table, bed or any low standing area, in the manner described above. It should be appreciated that the pivot post can be integrally formed with the first or second member or be a separate component that can be secured to the first or second member.

In an embodiment, a first handle tube 230 is sized to slide over friction post 206 of the first member. A second handle tube 232 is connected to the second member 204 in a suitable manner.

In the above embodiments, it should be appreciated that the cleaning member 116 may be any suitable cleaning member such as a broom head, brush, sweeper, dust mop, mop or other suitable cleaning member. Also in the above embodiments, the cleaner 100 and 200 are made of a combination of plastics and steel, such as stainless steel. It should be appreciated that the cleaner 100 and 200 may be made of any suitable material or combination of materials.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A household cleaning device comprising:

a cleaning member; and a handle connected to the cleaning member, the handle including a first member and a second member, the second member including a pivot post having a ball member and a pivot shaft, and the first member including a socket, the ball member being disposed in the socket to couple the first member and the second member and enable the second member to pivot with respect to the first member;

wherein the socket comprises a plurality of fingers, the plurality of fingers defining a plurality of pivot axes therebetween for receiving the pivot shaft.

2. The household cleaning device of claim 1, wherein the fingers are made of at least one of: a flexible material and a rigid material.

3. The household cleaning device of claim 1, which includes a first connector including the socket and a second connector including the ball member, wherein the first connector is removably connected to the first member and the second connector is removably connected to the second member.

4. The household cleaning device of claim 3, wherein at least one of the first and second members includes a cavity, at least one of the first connector and the second connector including ridges which frictionally engage an inside surface of the cavity.

5. The household cleaning device of claim 1, wherein the first member includes a grip.

6. The household cleaning device of claim 1, wherein the cleaning member is at least one of: a brush, a dust mop and a mop.

7. A household cleaning device comprising:

a cleaning member;

a handle connected to the cleaning member, the handle including a first member and a second member, the second member including a ball member and the first member including a socket, the ball member being disposed in the socket to couple the first member and the second member and enable the second member to pivot with respect to the first member; and a sleeve slidably connected to the handle and movable between a first position, which allows the second member to pivot, and a second position, which does not allow the second member to pivot;

wherein the sleeve in the second position encases the ball member and the socket by contacting at least a portion of each of the first member and the second member.

8. The household cleaning device of claim 7, wherein the second member includes a prong-shaped collar and the sleeve defines a prong-shaped end, and wherein the prong-shaped end of the sleeve engages the prong-shaped collar when the sleeve is in the second position.

9. The household cleaning device of claim 7, wherein the sleeve includes an actuator, which when activated, releases the sleeve from one of the first and second positions.

10. The household cleaning device of claim 7, which includes a first connector including the socket and a second connector including the ball member, wherein the first connector is removably connected to the first member and the second connector is removably connected to the second member.

11. The household cleaning device of claim 10, wherein at least one of the first and second members includes a cavity, at least one of the first connector and the second connector including ridges which frictionally engage an inside surface of the cavity.

12. The household cleaning device of claim 7, wherein the cleaning member is at least one of: a brush, a dust mop and a mop.

13. A household cleaning device comprising:

a cleaning member; and a handle connected to the cleaning member, the handle including a first member and a second member, the first member defining a socket and the second member defining an opening, the socket comprising a plurality of fingers; and a pivot member including a first end having a ball member and a pivot shaft and an opposing second end, the second end being disposed in the opening and secured to the second member, and the ball member being disposed in the socket to couple the first member and the second member and enable the second member to pivot with respect to the first member;

wherein the plurality of fingers define a plurality of pivot axes therebetween for receiving the pivot shaft.

14. The household cleaning device of claim 13, which includes a sleeve that is slidably connected to the handle and movable between a first position, which allows the second member to pivot, and a second position which at least partially covers the pivot member and which does not allow the second member to pivot.

15. The household cleaning device of claim 14, wherein the second member includes a prong-shaped collar and the sleeve defines a prong-shaped end, and wherein the prong-shaped end of the sleeve engages the prong-shaped collar when the sleeve is in the second position.

16. The household cleaning device of claim 14, wherein the sleeve includes an actuator, which when activated, releases the sleeve from one of the first and second positions.

17. The household cleaning device of claim 14, which includes a first connector including the socket and a second connector connected to the pivot member, wherein the first connector is removably connected to the first member and the second connector is removably connected to the second member.

18. The household cleaning device of claim 17, wherein at least one of the first and second members includes a cavity, at least one of the first connector and the second connector including ridges which frictionally engage an inside surface of the cavity.

19. The household cleaning device of claim 13, wherein the cleaning member is at least one of: a brush, a dust mop and a mop.

* * * * *